US010519709B2

(12) United States Patent
Ugliuzza

(10) Patent No.: US 10,519,709 B2
(45) Date of Patent: Dec. 31, 2019

(54) FLASHING RETAINER ASSEMBLY

(71) Applicant: Adam Ugliuzza, Lemoyne, PA (US)

(72) Inventor: Adam Ugliuzza, Lemoyne, PA (US)

( * ) Notice: Subject to any disclaimer, the term of this patent is extended or adjusted under 35 U.S.C. 154(b) by 0 days.

(21) Appl. No.: 15/985,178

(22) Filed: May 21, 2018

(65) Prior Publication Data

US 2019/0352956 A1 Nov. 21, 2019

(51) Int. Cl.

| | |
|---|---|
| ***E04H 4/14*** | (2006.01) |
| ***E04H 4/00*** | (2006.01) |
| ***E06B 1/62*** | (2006.01) |
| ***E04B 1/41*** | (2006.01) |
| *E04D 13/14* | (2006.01) |
| *E04D 13/03* | (2006.01) |

(52) U.S. Cl.

CPC ..... *E06B 1/62* (2013.01); *E04B 1/40* (2013.01); *E04D 13/0315* (2013.01); *E04D 13/1415* (2013.01); *E04H 4/141* (2013.01); *E04H 4/145* (2013.01); *E06B 2001/628* (2013.01)

(58) Field of Classification Search

CPC ... E04H 2004/146; E04H 4/145; E04H 4/141; E04H 4/14; E04H 4/00; E04F 13/00; E04F 17/00; E04D 13/0315; E04D 2013/0468; E04D 13/1415

USPC ..... 52/58, 60, 61, 62

See application file for complete search history.

(56) References Cited

U.S. PATENT DOCUMENTS

| | | | | | |
|---|---|---|---|---|---|
| 2,260,438 | A * | 10/1941 | Cheney | E04D 13/1415 | 52/60 |
| 3,793,795 | A * | 2/1974 | Annand | E04D 13/1415 | 52/61 |
| 4,165,589 | A * | 8/1979 | de Carteret | E04D 13/1415 | 52/61 |
| 4,190,989 | A * | 3/1980 | Sakharoff | E04D 13/1415 | 52/60 |
| 5,123,208 | A * | 6/1992 | Kirby | E04D 13/1415 | 52/58 |
| 5,357,720 | A * | 10/1994 | O'Keeffe | E04D 13/0315 | 52/200 |
| 5,553,425 | A * | 9/1996 | Sampson | E04D 13/0315 | 52/198 |
| 6,167,660 | B1 * | 1/2001 | Sama | E04D 13/1415 | 52/58 |
| 7,331,145 | B2 * | 2/2008 | Feucht | E04D 13/02 | 52/200 |

(Continued)

*Primary Examiner* — Phi D A

(74) *Attorney, Agent, or Firm* — Halbruner, Hatch & Guise, LLP

(57) ABSTRACT

The present invention provides an improved method for mounting and securing Flashing at exterior wall fenestration openings by using a three part system, Mounting Channel, Flashing, and Retaining Clip. The Mounting Channel is mounted at the opening or transition area when the framing is complete. The Flashing is inserted into the Mounting Channel. The Flashing is held in place with a Retaining Clip that uses tension to retain the Flashing in place. In this manner, the Flashing can be installed without the need for any mechanical fasteners and is designed to attach Flashing in a manner that allows fenestration to seal directly to the Air Barrier and reduce thermal bridging. Further, because the Flashing can be installed after all other exterior building components are installed, it is less likely that the Flashing will be damaged during the construction process.

12 Claims, 6 Drawing Sheets

(56) References Cited

U.S. PATENT DOCUMENTS

2002/0124480 A1* 9/2002 Morphet ..... E04D 3/08
52/58
2003/0061771 A1* 4/2003 Kintop ..... E04D 13/155
52/97

* cited by examiner

Figure 4
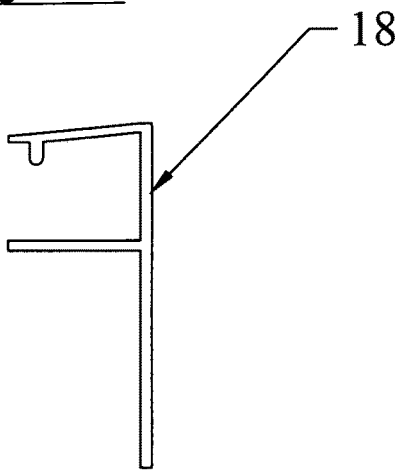
Figure 4A
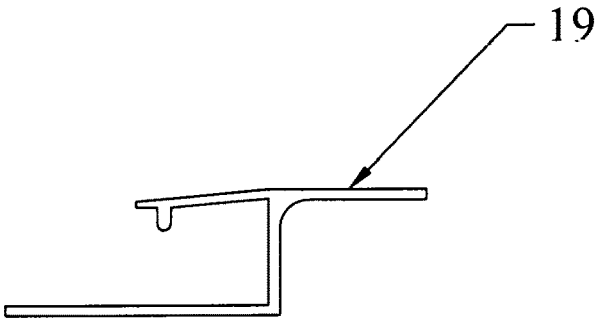
Figure 4B
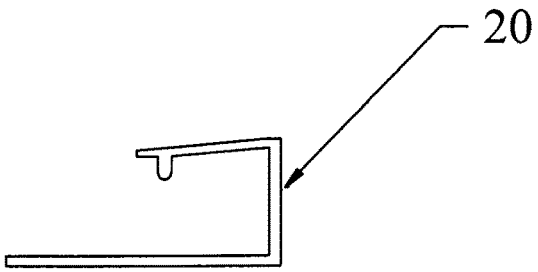
Figure 4C

FLASHING RETAINER ASSEMBLY

CROSS REFERENCE TO RELATED APPLICATIONS

The application is based upon and claims priority from a Provisional Patent Application filed as Jun. 5, 2017 Application No. 62/603,513 by Ugliuzza.

STATEMENT REGARDING FEDERALLY SPONSORED RESEARCH OR DEVELOPMENT

This invention was not made with any government support.

BACKGROUND OF THE INVENTION

Flashing is the method of transitioning or terminating of exterior building components. Metal flashing is typically used at exterior wall opening conditions that employ fenestration components, including but not limited to, windows, doors, storefront, window wall, curtain wall, louvers and building enclosure transitions and terminations of, including but not limited to, cladding, air barriers, weather resistive barriers, waterproofing and roofing. Metal flashing's functional purpose is to provide environmental protection and to divert water away from the building at transitions or terminations of exterior building components. The flashing's aesthetic purpose is to provide an attractive transition or termination of exterior building components. The current method for flashing at exterior wall fenestration openings involves the placing of flashing after the support framing is complete. The flashing is typically secured with mechanical fasteners such as nails or screws that penetrate the flashing. In many cases, the mechanical fasteners secure the flashing at a horizontal and vertical return surfaces of the fenestration opening. The penetrations created by the attachment of the flashing and the attachment are typically sealed with an elastomeric mastic or sealant. Functionally, with the current method, the penetrations for the attachment allow for a point of entry for future air leakage or water penetration when the mastic or sealant fails, is not installed properly or is not installed at all.

Further, flashing is often required to be mounted prior to adjacent exterior building components in order to conceal the mechanical fasteners that are used to attach the metal flashing. This condition limits the ability to modify or replace the metal flashing later without removal of the concealing fenestration and is a thermal bridge. This installation method also limits construction sequencing and can create conditions where the metal flashing is exposed and more prone to damage before the remaining exterior building components can be installed.

BRIEF SUMMARY OF THE INVENTION

The present invention provides an improved method by using a three part system, Mounting Channel, Flashing, and Retaining Clip. The Mounting Channel is mounted at the opening or transition area when the framing is complete. Once installation of the adjacent exterior building component is complete, the Flashing can then be installed into the Mounting Channel. This Flashing is a traditional style flashing typically made out of aluminum or other materials with similar characteristics. The Flashing is inserted into the Mounting Channel. The Flashing is held in place with a Retaining Clip that uses tension to retain the Flashing in place. In this manner, the Flashing can be installed without the need for any mechanical fasteners, which create a point of penetration. Further, because the Flashing can be installed after all other exterior building components are installed it is less likely that the Flashing will be damaged during the construction process. Finally, the invention provides a removable Flashing due to the ability to disconnect the Retaining Clip, making building maintenance, inspection and replacement possible.

BRIEF DESCRIPTION OF DRAWINGS

FIG. 4: Cross-section of Alternate Embodiments of Mounting Channel

FIG. 4A: Alternate Embodiment with Primary Member removed for mounting on one plane where the flashing is perpendicular to the attachment plane.

FIG. 4B: Alternate Embodiment with Second Member removed for mounting at opening of existing wall.

FIG. 4C Alternate Embodiment with Primary Member and Second Member removed for mounting flashing to one plane where the flashing is parallel to the attachment plane.

LABEL LIST

Figure 1:
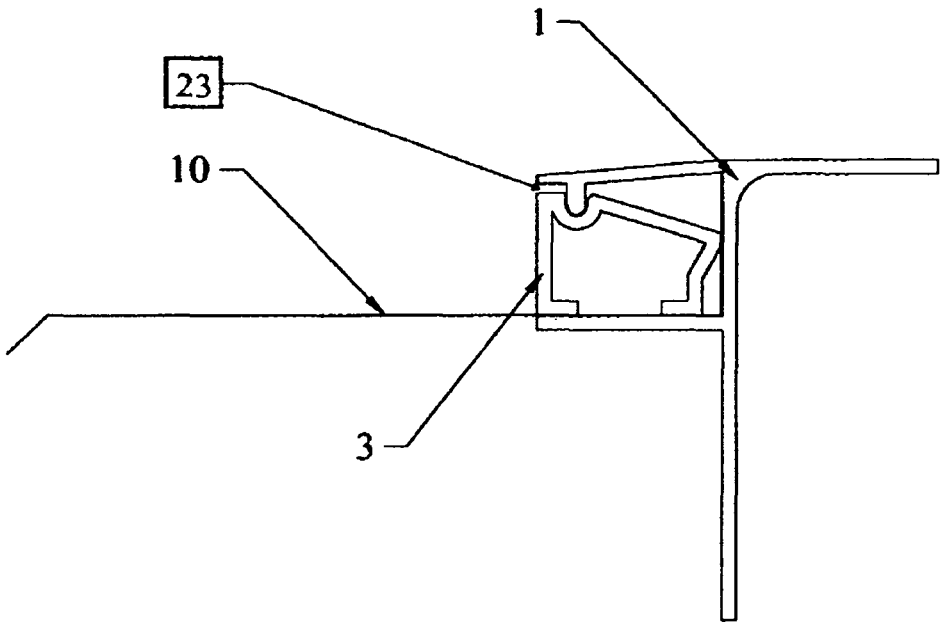
FIG. 1: Cross-section of Assembled Apparatus
Figure 2:
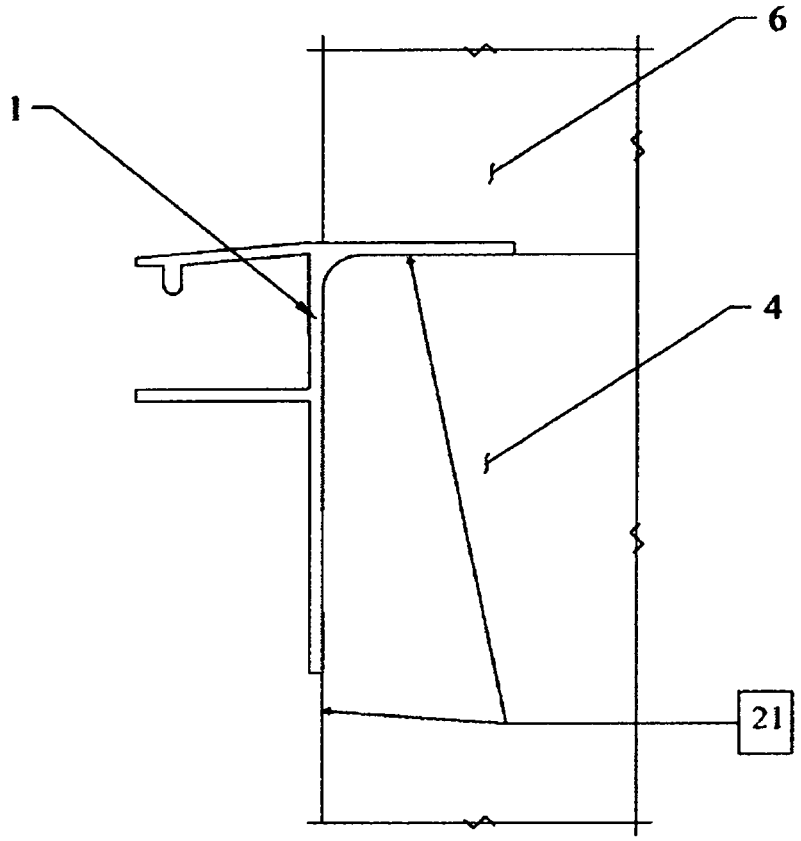
FIG. 2: Cross-section of Mounting Channel with Exterior Building Components
Figure 3:
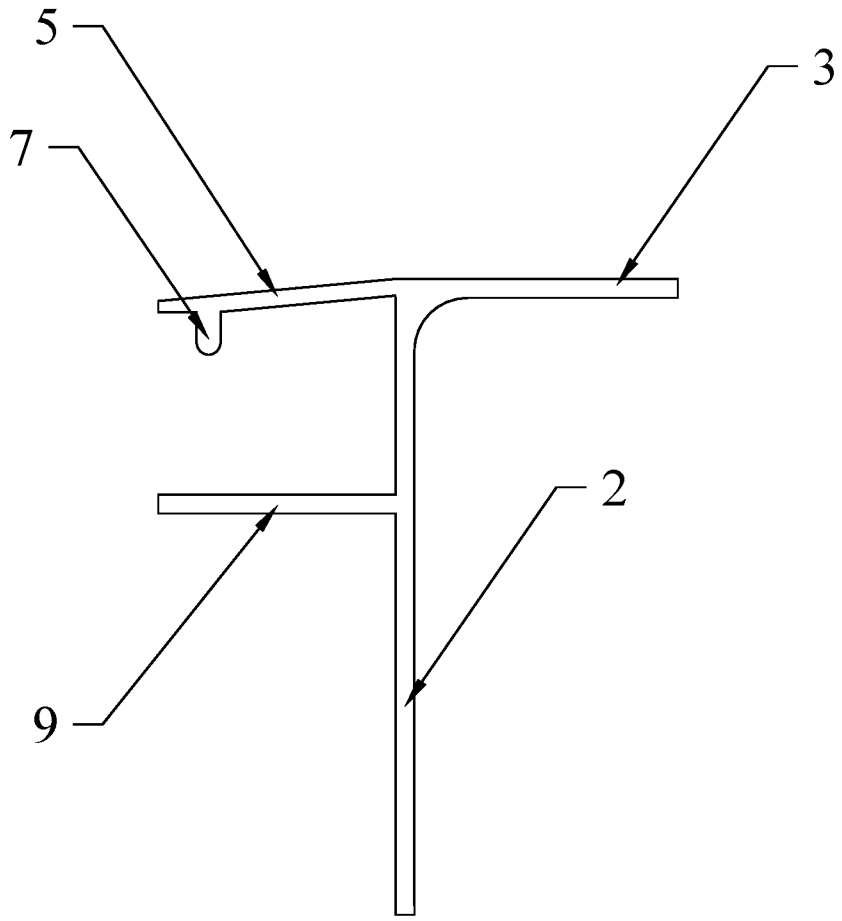
FIG. 3: Cross-Section of Mounting Channel
Figure 5:
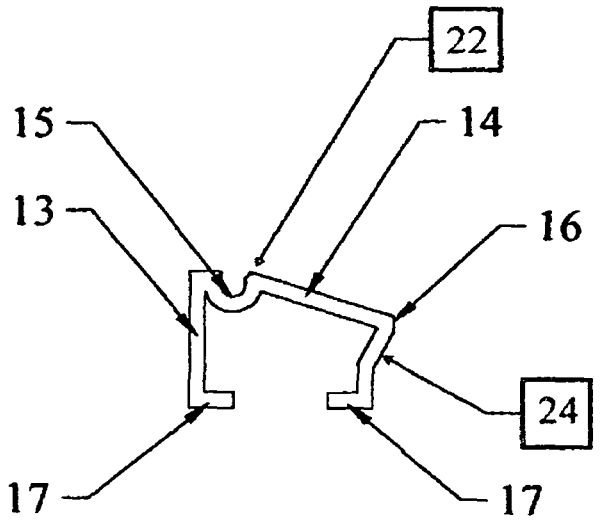
FIG. 5: Cross Section of Retaining Clip
Figure 6:
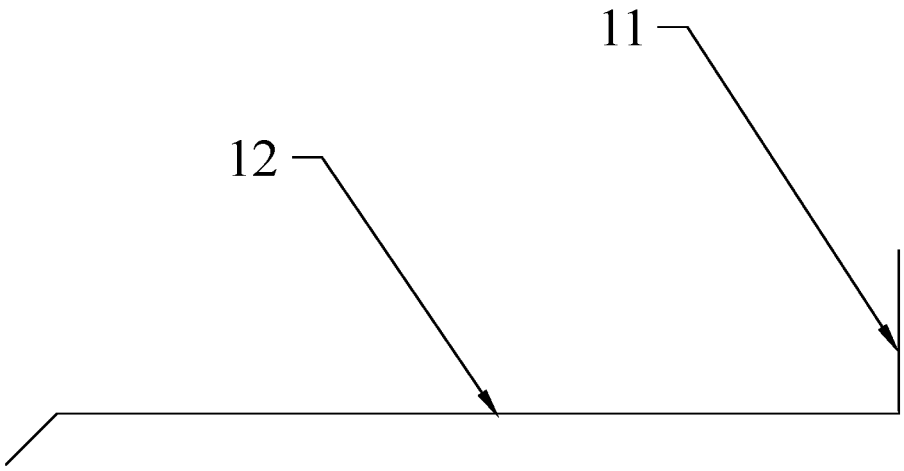
FIG. 6: Cross Section of Flashing

1. Mounting Channel
2. Primary Member
3. Second Member
4. Building Structure
5. Retaining Arm Component
Fenestration
7. Key
8. Retaining Clip
9. Flashing Mounting Component
10. Flashing
11. Short Bent Leg
12. Projected Leg
13. First Element
14. Upper Surface
15. Key Way
16. Rear Element
17. Foot Elements
18. Mounting Channel, Alternate Embodiment 1
19. Mounting Channel, Alternate Embodiment 2
20. Mounting Channel, Alternate Embodiment
21. Air Barrier
22. Chamfer
23. Tool Slot
24. Angled Leg

DETAILED DESCRIPTION OF PREFERRED EMBODIMENT

The invention is an Exterior Wall Fenestration Opening Flashing Assembly. A three part apparatus for Flashing the perimeter of exterior wall fenestration that does not interrupt the continuity of the air barrier at the interface of the exterior wall and fenestration. The first part being the "Mounting Channel" (1), is made of a rigid elastic material, which in the preferred embodiment is stainless steel, aluminum, or plastic. The "Mounting Channel" consists of the Primary Member (2) that is connected to the Second Member (3) that lies at a right angle to the Primary Member (2) and projects towards the interior of the structure. The Primary Member (2) is affixed to the Building Structure (4) that is covered by an Air Barrier (21) (with either mechanical fasteners or adhesive. The Second Member (3) is designed to conceal the Air Barrier (2D at the fenestration opening.

The "Retaining Arm Component" (5) is oriented at acute angle to the Primary Member (2). The Retaining Arm Component (5) is oriented at an acute angle to prevent the accumulation of water on a horizontal surface at the exterior side of the Window or other Building Material (6) and to maintain a rectilinear, uniform profile. Any water that falls on the Retaining Arm Component (5) will drain outward toward the exterior of the building along the Retaining Arm Component (5). Additionally the acute angle helps retain and lock the Retaining Clip (8). The rectilinear, uniform profile design enables the Exterior Wall Fenestration Opening Flashing Assembly to be used around the perimeter of the fenestration opening, thereby eliminating gaps at corner transitions caused by non-rectilinear profiles.

Located near the outermost portion of the Retaining Arm Component (5) is a vertical protrusion (the "Key") (7) that projects from the Retaining Clip (8) side of the Retaining Arm Component (5). The Key provides a mechanical means to secure the Retaining Clip (8).

Further, projecting from the Primary Member (2) on the same side as the Retaining Arm Component (5) is the "Flashing Mounting Component" (5). The Flashing Mounting Component (5) is the base upon which the "Retaining Clip" (8) rests. In the preferred embodiment, the Flashing Mounting Component (9) is perpendicular to the Primary Member (2). The Primary Member (2) acts as stop, limiting the insertion depth of the Retaining Clip (8) and the Flashing. The Flashing Mounting Component also helps to support the Flashing (10). The Flashing Mounting Component (9) receives the Flashing (10) and serves as a base for the insertion of the Retaining Clip (8).

There are three alternate embodiments of the Mounting Channel. The First Alternate Embodiment (18) has a portion of the Primary Member removed for mounting on one plane where the flashing is perpendicular to the attachment plane. The Second Alternate Embodiment (19) has a portion of the Second Member removed for mounting at the opening of an existing wall. The Third Alternate Embodiment (20) has a portion of the Primary Member and Second Member removed for mounting flashing to one plane where the flashing is parallel to the attachment plane. Flashing (10) is the second part of the apparatus. In the preferred embodiment the Flashing (10) is any type of commercially available Flashing (typically being aluminum or stainless steel) that is bent at approximately a right angle so that there is a Short Bent Leg (11) and Projected Leg (12). The short bent leg (11) interfaces with the primary member (2) and the portion of the projected leg beyond the Flashing Mounting Component (9) may be bent or shaped to conform to the adjoining exterior building component.

The "Retaining Clip" (8) is the third part of the apparatus. The Retaining Clip (8) serves the function of mechanically securing the Flashing (10) to the Mounting Channel (1). The Retaining Clip (8) in the preferred embodiment is made of the same material as the Mounting Channel (1). The Retaining Clip (8) consists of four distinct elements.

The First Element (13) is the outer edge of the Retaining Clip (8). This First Element is oriented at a right angle to the Flashing Mounting Component (9) to allow for the drainage of water to the projected leg of the Flashing (10). Further, the First Element (13) is oriented in such a manner to press the Retaining Clip (8) into place using their thumbs.

The second element of the Retaining Clip is the Upper Surface (14). The Upper Surface (14) of the Retaining Clip (8) contains a semi-circular Key Way (15) to accept the semi-circular Key (7). The Key (7) and the Key Way (15) are semi-circular to reduce friction during installation and to interlock in a manner to securely hold the Retaining Clip (8) in place. Further, the Upper Surface (14) of the Retaining Clip (8) is oriented at an angle to allow for it to wedge open the Flashing Mounting Component (9) and the Retaining Arm Component (5) as the Retaining Clip (8) is inserted. The leading edge of the Upper Surface (14) includes a Chamfer (22) to allow the Key (7) to slide into the Keyway (15). The Key (7) and the Key Way (15) can be released by applying upward pressure with a tool from the Tool Slot (23), located at to the lower surface and outer edge of the Retaining Arm Component (5). The third and fourth elements of the Retaining Clip (8) are designed to secure the Flashing in the Mounting Channel. The third element of the Retaining Clip is the Rear Element (16) of the Retaining Clip (8). The third element of the Retaining Clip (8) will contact the Bent Leg (11) of the Flashing (10) securing it against the Primary Member (2). When the Retaining Clip (8) is engaged the Rear Element (16) contacts the Primary Member (2) which prevents the Retaining Clip (8) to resist rotational movement of the Retaining Clip (8). The fourth element of the Retaining Clip are the Foot Elements (17). The Foot Elements (17) of the Retaining Clip contact the projected leg of the Flashing (12) using compressive force to secure it against the Flashing Mounting Component (9) eliminating the need for mechanical fasteners. The Rear Element (16) and the rear Foot Element (17) are connected by an Angled Leg (24), and the angle of the leg is designed to accommodate varying thicknesses of Flashing (12) and Flashing (12) splices, thus allowing the four points of contact to be contained within the Mounting Channel (1) and the rectilinear profile to be maintained.

Together the three components, the Mounting Channel (1), Flashing (10) and Retaining Clip (8) create a unique apparatus for mounting flashing at exterior wall fenestration opening conditions that employ fenestration components, including but not limited to, windows, doors, storefront, window wall, curtain wall, louvers and building enclosure transitions and terminations of, including but not limited to, cladding, air barriers, weather resistive barrier, waterproofing and roofing.

What is claimed:

1. An Exterior Wall Fenestration Opening Flashing Assembly for installing Flashing, comprised of a combination of a Mounting Channel and a Retaining Clip, both constructed of at least one of metal and plastic; the mounting channel is adapted to affix to a building Structure outside of the fenestration opening, and is comprised of a Retaining Arm Component, oriented at an acute angle to a Primary Member that includes a semi-circular Key located at the outermost portion of the Retaining Arm Component that projects toward a Flashing Mounting Component to secure the Retaining Clip, and the Flashing Mounting Component, oriented perpendicular to the Primary Member and supports the base of the Retaining Clip and Flashing; the Flashing Mounting Component orients the Flashing perpendicular to the Primary Member; the Retaining Arm Component and the Flashing Mounting Component project from one side of the Primary Member to create the Mounting Channel that receives the Retaining Clip and the Primary Member and is a stop that limits the insertion depth of the Retaining Clip and the Flashing; the Retaining Clip and Flashing are secured against the Flashing Mounting Component and Primary Member of the Mounting Channel by a compressive force from the Retaining Arm Component; the Retaining Clip is comprised of an Upper Surface that includes a Keyway, semi-circular in shape, at the outer edge of the Upper Surface for connection to a Key, semi-circular shape, of the Retaining Arm Component, which is a first support point for the Retaining Clip to the Mounting Channel, and the inner portion of the Upper Surface is sloped inward and towards the base of the Retaining Clip for orientation of the Retaining Arm Component for the Key and Keyway connection; the outer edge of the angled portion of the Upper Surface includes a Chamfer for easier connection of Key and Keyway; a First Element connects to the outer edge of the Upper Surface and is oriented perpendicular to the Retaining Arm Component and Flashing Mounting Component to maintain a rectilinear profile in combination with the Mounting Channel; an outer Foot Element projects inward perpendicularly from the base of the First Element and rests against the Flashing and is a second support point for the Retaining Clip to the Mounting Channel; a Rear Element connects to the inner edge of the Upper Surface, projects towards the base of the Retaining Clip, is parallel to the Primary Member and rests against the Mounting Channel and is a third support point for the Retaining Clip to the Mounting Channel; an Angled Leg projects from the Rear Element at an angle outward and towards the base of the Retaining Clip to contact the Flashing; a rear Foot Element connects to the base of the Angled Leg and projects outward and rests against the Flashing and is a fourth support point for the Retaining Clip to the Mounting Channel.

2. The Exterior Wall Fenestration Opening Flashing Assembly of claim 1, wherein the Flashing includes a Short Bent Leg bent at a ninety-degree angle at the Primary Member for the Angled Leg of the Retaining Clip to receive; wherein the Flashing thickness determines the length of the bent leg corresponding to its first contact with the Angled Leg.

3. The Exterior Wall Fenestration Opening Flashing Assembly of claim 1, wherein the Upper Surface of the Retaining Clip is sloped, to create a force that opens the Retaining Arm Component for installation of the Retaining Clip; as installer presses the Retaining Clip into the Mounting Channel, the Upper Surface slides against the semi-circular Key until the Key reaches the Chamfer of the Upper Surface, wherein the semi-circular shape of the Key and the Chamfer both reduce friction of the Key against the Upper Surface for the Key and Keyway connection.

4. The Exterior Wall Fenestration Opening Flashing Assembly of claim 1, wherein there is a Tool Slot at the junction of the exterior edge of the Retaining Arm Component and the First Element of the Retaining Clip due to a disparity in length of the Key and depth of the Keyway.

5. The Exterior Wall Fenestration Opening Flashing Assembly of claim 4, wherein the Tool Slot is to receive a tool for the removal of the Retaining Clip, through the insertion of a tool into the Tool Slot that is rotated toward the Flashing, in a plane perpendicular to the length of the Tool Slot, which disengages the Key from the Keyway.

6. The Exterior Wall Fenestration Opening Flashing Assembly of claim 1, wherein the Retaining Clip is for installing Flashing after installing fenestration and an exterior wall cladding disconnected from an Air Barrier existing on the Building Structure.

7. The Exterior Wall Fenestration Opening Flashing Assembly of claim 1, installing the Exterior Wall Fenestration Opening Flashing Assembly occurs after installing the fenestration and exterior wall cladding.

8. The Exterior Wall Fenestration Opening Flashing Assembly of claim 6, wherein the Retaining Clip is for installing Flashing without splice joints at fenestration opening corner transitions.

9. The Exterior Wall Fenestration Opening Flashing Assembly of claim 1, wherein a Second Member projects inward from the Mounting Channel perpendicular to the Primary Member that extends into the opening to conceal an Air Barrier.

10. The Exterior Wall Fenestration Opening Flashing Assembly of claim 1, that provides a thermally improved attachment for reducing the transfer of heat between the exterior and interior components of the building.

11. The Exterior Wall Fenestration Opening Flashing Assembly of claim 1, wherein the Mounting Channel and the Retaining Clip are both constructed of plastic.

12. The Exterior Wall Fenestration Opening Flashing Assembly of claim 1, wherein the Angled Leg of the Retaining Clip is oriented at an angle to the Primary Member to accommodate varying thicknesses of flashing and flashing splice joints.

* * * * *